US008431003B2

(12) United States Patent
Sato

(10) Patent No.: US 8,431,003 B2
(45) Date of Patent: Apr. 30, 2013

(54) ELECTRODEPOSITION-COATING MONITORING SYSTEM AND METHOD, AND METHOD OF MANUFACTURING ELECTRODEPOSITION-COATED ARTICLE

(75) Inventor: Kozo Sato, Ichinomiya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 297 days.

(21) Appl. No.: 13/062,736

(22) PCT Filed: Sep. 8, 2009

(86) PCT No.: PCT/IB2009/006775

§ 371 (c)(1),
(2), (4) Date: Mar. 8, 2011

(87) PCT Pub. No.: WO2010/026480

PCT Pub. Date: Mar. 11, 2010

(65) Prior Publication Data

US 2011/0162970 A1 Jul. 7, 2011

(30) Foreign Application Priority Data

Sep. 8, 2008 (JP) ..... 2008-229270

(51) Int. Cl.
*C25D 13/22* (2006.01)
*C25D 21/12* (2006.01)

(52) U.S. Cl.
USPC ..... 204/472; 204/474; 204/623

(58) Field of Classification Search ..... 204/472, 204/474, 623, 229.8; 205/83
See application file for complete search history.

(56) References Cited

U.S. PATENT DOCUMENTS

| | | | | |
|---|---|---|---|---|
| 5,914,022 | A | 6/1999 | Lowry et al. | |
| 7,349,755 | B2 * | 3/2008 | Contos et al. | 700/123 |
| 8,313,627 | B2 * | 11/2012 | Gerharz et al. | 204/472 |

FOREIGN PATENT DOCUMENTS

| | | | |
|---|---|---|---|
| DE | 10 2005 037174 | B3 | 6/2006 |
| GB | 1 075 083 | A | 7/1967 |
| GB | 2 307 053 | A | 5/1997 |
| JP | 01-087169 | U | 6/1989 |
| JP | 8-199398 | A | 8/1996 |
| JP | 2006-097119 | A | 4/2006 |

* cited by examiner

*Primary Examiner* — Kishor Mayekar
(74) *Attorney, Agent, or Firm* — Kenyon & Kenyon LLP

(57) ABSTRACT

A monitoring method of the invention is for monitoring electrodeposition coating of an object to be coated in which a conveying mechanism that conveys the object to be coated while the object is immersed in an electrodeposition paint in an electrodeposition bath, and a plurality of electrodes arranged along a conveying direction in which the object to be coated is conveyed by the conveying mechanism, are used, the method including: acquiring present position data of the object in the conveying direction; when the acquired present position data has a value corresponding to a predetermined determination position, acquiring an electric current value corresponding to a predetermined one, associated with the determination position, of the electrodes; and determining the occurrence of the abnormality for the object to be coated that is positioned at the determination position, based on whether the acquired electric current value is within a predetermined range.

18 Claims, 3 Drawing Sheets

ELECTRODEPOSITION-COATING MONITORING SYSTEM AND METHOD, AND METHOD OF MANUFACTURING ELECTRODEPOSITION-COATED ARTICLE

This is a 371 national phase application of PCT/IB2009/006775 filed 8 Sep. 2009, claiming priority to Japanese Patent Application No. 2008-229270 filed 8 Sep. 2008, the contents of which are incorporated herein by reference.

BACKGROUND OF THE INVENTION

1. Field of the Invention

The invention relates to an electrodeposition-coating monitoring system and method, and a method of manufacturing an electrodeposition-coated article, in which an electrodeposition coating apparatus for performing electrodeposition coating by conveying an object to be coated while the object is immersed in a liquid electrodeposition paint. More specifically, the invention relates to an electrodeposition-coating monitoring system and method, in which an apparatus is monitored in which objects to be coated are continuously conveyed and electrodeposition coating on a plurality of objects to be coated is performed in parallel, and to a method of manufacturing electrodeposition-coated articles in which the electrodeposition-coated articles are manufactured while monitoring is performed.

2. Description of the Related Art

In a process of undercoating a body of a car, electrodeposition coating has been widely performed in which the body is immersed in a liquid electrodeposition paint in an electrodeposition bath. In the electrodeposition bath, many electrodes are disposed on the side surfaces and the bottom surface of the electrodeposition bath. When an undercoating process is performed, objects to be coated are conveyed in the electrodeposition paint while voltage is applied to these electrodes. In such an electrodeposition coating apparatus, thought is given to the shape and arrangement of the electrodes so as to form a coat on the surface of the coated objects evenly as much as possible (see Japanese Patent Application Publication No. 8-199398 (JP-A-8-199398)).

Japanese Patent Application Publication No. 2006-97119 (JP-A-2006-97119) describes a method of measuring the amount of coating and the thickness of the coat on each object to be coated in an apparatus in which a plurality of objects to be coated are simultaneously immersed in an electrodeposition paint by continuously conveying a plurality of objects to be coated along the electrodeposition bath. According to the technology described in this document, the variation with time of the values of the electric currents flowing through a plurality of electrodes is measured, and the component corresponding to the object to be coated concerned is extracted from the variation with time and integrated. This document says that, in this way, it is possible to obtain the number of coulombs that flow through the object to be coated concerned, and based on the number of coulombs, it is possible to calculate the amount of coating.

However, in the system described in the above JP-A-2006-97119, the data concerning the variation with time of the electric current value is used to differentiate a plurality of objects to be coated from each other that are simultaneously conveyed. Although it is possible to determine the total amount of coating for each object to be coated during a coating process with the use of this system, the system is not designed to determine the electric current value when the object to be coated is at the position at which the object faces an electrode. Thus, there has been a problem that even when a failure occurs in an electrode, for example, it is difficult to detect the occurrence of the failure when the variation in the amount of coating is compensated for by another electrode.

In addition, when it is intended to measure the total amount of coating, the result can be obtained only after the object to be coated is taken out. Thus, depending on the portion in which the failure occurs, there has been a fear that defects can occur in the objects to be coated that are put into the bath after the occurrence of the failure.

SUMMARY OF THE INVENTION

The invention provides an electrodeposition-coating monitoring system and method, and a method of manufacturing an electrodeposition-coated article, with which it is possible to monitor an electrodeposition coating process, quickly detect the occurrence of a failure in the state of the coating and/or in a coating apparatus, and provide notification about such an occurrence.

An electrodeposition-coating monitoring system according to a first aspect of the invention includes: an electrodeposition bath that contains an electrodeposition paint; a conveying mechanism that conveys the object to be coated while the object is immersed in the electrodeposition paint in the electrodeposition bath; a plurality of electrodes arranged along a conveying direction in which the object to be coated is conveyed by the conveying mechanism; a present-position-data acquisition section that acquires present position data of the object to be coated in the conveying direction in which the object to be coated is conveyed by the conveying mechanism; an electric-current-data collection section that collects individual values of electric currents that flow through the plurality of electrodes, respectively; and an abnormality determination section that determines the occurrence of an abnormality in electrodeposition coating based on the electric current value, collected by the electric-current-data collection section, of the electrode positioned at a point corresponding to the present position data acquired by the present-position-data acquisition section.

In an electrodeposition coating process, an object to be coated is conveyed while the object is immersed in an electrodeposition paint, whereby the object is electrodeposition coated. An electrodeposition-coating monitoring system according to the first aspect of the invention is for monitoring such an electrodeposition coating process. According to the invention, data concerning the present position at which the object to be coated is being conveyed is acquired by the present-position-data acquisition section, and electric current values are collected by the electric-current-data collection section on an electrode-by-electrode basis. In addition, using such data, the abnormality determination section determines the occurrence of the abnormality based on the electric current value of the electrode positioned at a point corresponding to the data concerning the present position at which the object to be coated is being conveyed. In this way, it is possible to monitor an electrodeposition coating process, quickly detect the occurrence of a failure in the state of the coating and/or in a coating apparatus, and provide notification about such an occurrence.

In the first aspect of the invention, the present-position-data acquisition section may acquire the present position data based on data concerning a carried distance by which the object to be coated is carried along the conveying mechanism. The present-position-data acquisition section may acquire the present position data based on information obtained from the conveying mechanism. A configuration may be adopted in which, when the present position data acquired by the present-position-data acquisition section has a value corresponding to a predetermined determination position, the abnormality determination section acquires one, corresponding to a predetermined electrode associated with the determination position, of the electric current values collected by the electric-current-data collection section, and based on whether the acquired electric current value is within a predetermined range, the abnormality determination section determines the occurrence of the abnormality for the object to be coated that is positioned at the determination position. With this configuration, it is possible to determine whether the electric current value of the predetermined electrode associated with the predetermined determination position is within the predetermined range. That is, it is possible to select and set the determination position and the electrodes in accordance with the electrodeposition coating process.

Further, in the first aspect of the invention, the electrodeposition-coating monitoring system may further include: a passing sensor that outputs a passing signal when the object to be coated passes by a predetermined point on the conveying mechanism; a conveying signal output section that outputs a conveying signal that periodically varies while the conveying mechanism is conveying the object to be coated; and a counter that is started by the passing signal and counts cycles by which the conveying signal periodically varies, and the present-position-data acquisition section may use the thus-obtained cycle count as the present position data. For example, the passing sensor may be a mechanical sensor that is switched on and off when an object to be coated passes by the passing sensor. Alternatively, the passing sensor may be an optical sensor or an electromagnetic sensor that detects passing of an object to be coated. A conveyor pulse signal that is used to control driving of the conveyor, for example, may be used as the conveying signal. The conveying signal is not limited as long as the cycle count value of the conveying signal and the carried distance by which an object to be coated is conveyed by the conveying mechanism have a one-to-one correspondence.

In the first aspect of the invention, the electrodeposition-coating monitoring system may further include an abnormality notification device that, when the abnormality determination section detects the occurrence of the abnormality, provides notification about the occurrence of the abnormality.

A second aspect of the invention is an electrodeposition-coating monitoring method in which electrodeposition coating of an object to be coated is monitored that uses an electrodeposition bath that contains an electrodeposition paint, a conveying mechanism that conveys the object to be coated while the object is immersed in the electrodeposition paint in the electrodeposition bath, and a plurality of electrodes arranged along a conveying direction in which the object to be coated is conveyed by the conveying mechanism, the electrodeposition-coating monitoring method including: acquiring present position data of the object to be coated in the conveying direction in which the object to be coated is conveyed by the conveying mechanism; acquiring an electric current value of the electrode positioned at a point corresponding to the acquired present position data; and determining an occurrence of an abnormality in the electrodeposition coating based on the acquired electric current value.

A third aspect of the invention is a method of manufacturing an electrodeposition-coated article in which an electrodeposition bath that contains an electrodeposition paint, a conveying mechanism that conveys the object to be coated while the object is immersed in the electrodeposition paint in the electrodeposition bath, and a plurality of electrodes arranged along a conveying direction in which the object to be coated is conveyed by the conveying mechanism are used, the method including: acquiring present position data of the object to be coated in the conveying direction in which the object to be coated is conveyed by the conveying mechanism; acquiring an electric current value of the electrode positioned at a point corresponding to the acquired present position data; and performing electrodeposition coating while repeatedly determining an occurrence of an abnormality in the electrodeposition coating based on the acquired electric current value.

In the electrodeposition-coating monitoring method and the method of manufacturing an electrodeposition-coated article according to the second and third aspects of the invention, the present position data may be acquired based on data concerning a carried distance by which the object to be coated is carried along the conveying mechanism. The present position data may be acquired based on information obtained from the conveying mechanism. In the methods according to the second and third aspects of the invention, the electric current value acquiring step may be such that, when the acquired present position data has a value corresponding to a predetermined determination position, an electric current value corresponding to a predetermined one, associated with the determination position, of the plurality of electrodes is acquired, and, the determining step may be such that the occurrence of the abnormality for the object to be coated that is positioned at the determination position is determined based on whether the acquired electric current value is within a predetermined range.

In the electrodeposition-coating monitoring method and the method of manufacturing an electrodeposition-coated article according to the second and third aspects of the invention, each of the methods may further include: outputting a conveying signal that periodically varies while the conveying mechanism is conveying the object to be coated; counting cycles by which the conveying signal periodically varies, from when the object to be coated passes by a predetermined position on the conveying mechanism; and using a thus-obtained cycle count as the present position data of the object to be coated in the conveying direction in which the object to be coated is conveyed by the conveying mechanism. Each of the methods according to the second and third aspects of the invention may further include, when the occurrence of the abnormality is detected, causing an abnormality notification device to provide notification about the occurrence of the abnormality.

With any of the electrodeposition-coating monitoring system and method, and the method of manufacturing an electrodeposition-coated article, it is possible to monitor an electrodeposition coating process, quickly detect the occurrence of a failure in the state of the coating and/or in a coating apparatus, and provide notification about such an occurrence.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

An embodiment of the invention will be described below in detail with reference to the attached drawings. In this embodiment, the invention is applied to an electrodeposition-coating monitoring system that controls an electrodeposition coating apparatus for undercoating a body of a car and monitoring whether a favorable electrodeposition coating is being performed.

Figure 1:
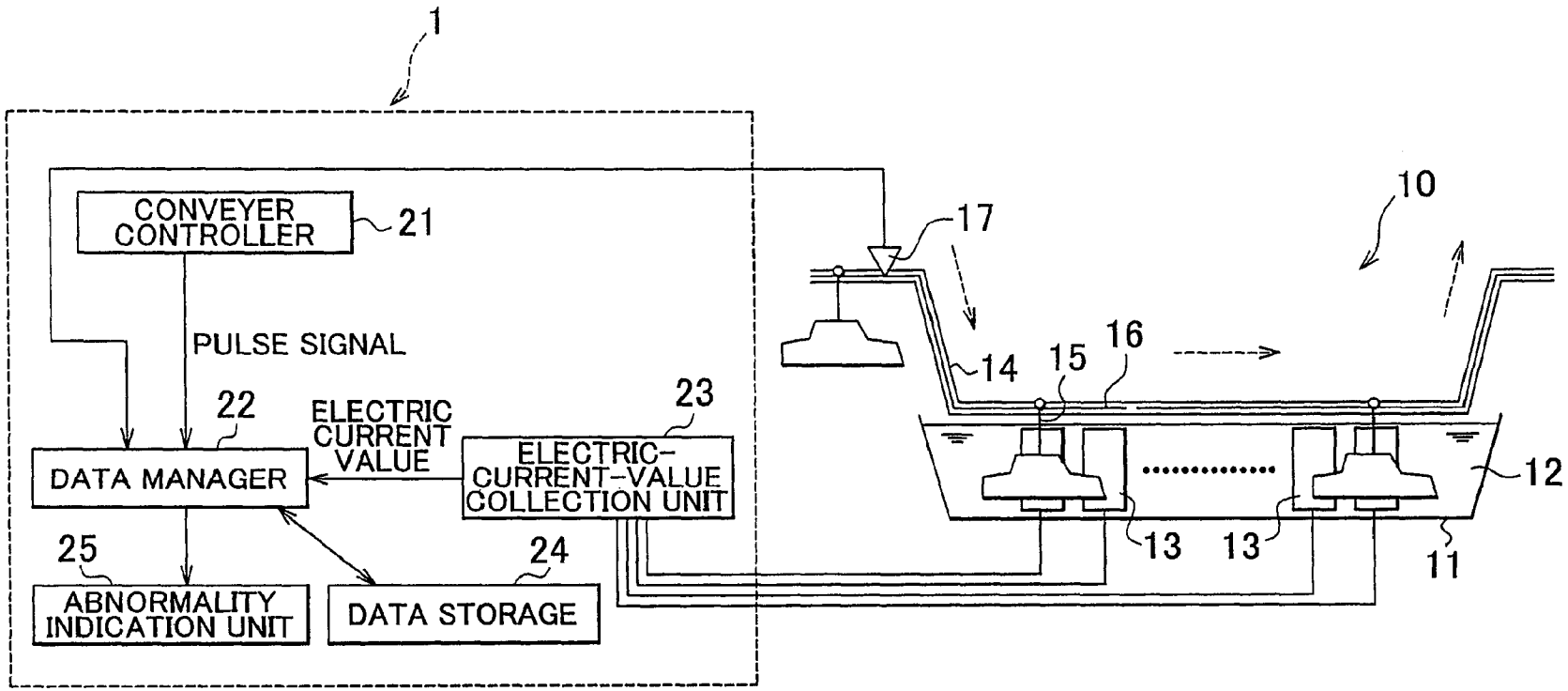
FIG. 1 is a schematic configuration diagram showing an electrodeposition coating apparatus and an electrodeposition-coating monitoring system according to an embodiment.

As shown in FIG. 1, the electrodeposition-coating monitoring system 1 of this embodiment is used in a state where the electrodeposition-coating monitoring system 1 is connected to an electrodeposition coating apparatus 10. Thus, the electrodeposition coating apparatus 10 will be first briefly described. The electrodeposition coating apparatus 10 has an electrodeposition bath 11 filled with a liquid electrodeposition paint 12, and has a plurality of electrodes 13 disposed in the electrodeposition bath 11. In this embodiment, the electrodeposition bath 11 has a size large enough to accommodate a plurality of bodies in the longitudinal direction of the electrodeposition bath 11 (horizontal direction in FIG. 1).

Although the plurality of electrodes 13 are simplified in FIG. 1, the plurality of electrodes 13 are not uniform in actual, that is, the plurality of electrodes 13 include flat electrodes and rod-like electrodes, for example. These electrodes are properly arranged so as to be able to favorably coat objects to be coated (bodies of cars in this embodiment). The electrodes 13 are disposed not only on the side surfaces of the electrodeposition bath 11 but also on the bottom surface thereof.

As shown in FIG. 11, a rail 14 for a conveyor is spanned over the electrodeposition bath 11, shaped so as to extend along the bottom surface of the electrodeposition bath 11. When an electrodeposition process according to this embodiment is performed, bodies of cars are hanged from the rail 14 through hangers 15. The bodies can be conveyed along the electrodeposition bath 11 by driving the conveyor as shown by the broken-line arrows in FIG. 1. Specifically, when an electrodeposition coating is performed, the bodies are put into the electrodeposition bath 11 from the left end in FIG. 1, move in the electrodeposition bath 11 in the longitudinal direction of the electrodeposition bath 11, and are taken out of the electrodeposition bath 11 at the right end in FIG. 1. In this embodiment, the conveying speed of the conveyor is set so that the time during which a body is immersed in the paint in the electrodeposition bath 11 is within a proper range.

In this embodiment, the electrodes 13 are grouped, where each group includes one electrode or a plurality of electrodes, and voltage is applied to bodies, which are the coated objects. For this reason, on the body side, bus bars 16 are provided along the rail 14. It should be noted that a single electrode 13 and a set of a plurality of electrodes 13 that belong to a group are both simply referred to as the electrode 13.

As shown in FIG. 1, in this embodiment, the bus bars 16 that are used include two segments above the electrodeposition bath 11. Thus, it is possible to apply voltages with different values to the electrodes 13 disposed in the upstream side and the electrodes 13 disposed in the downstream side, respectively. A line sensor (LS) 17 for detecting the passing of the hanger 15 is disposed near the start point of the rail 14. The position at which the LS 17 is attached is before the entrance point at which bodies are put into the electrodeposition bath 11.

Next, the electrodeposition-coating monitoring system 1 will be described. As shown in FIG. 1, the electrodeposition-coating monitoring system 1 of this embodiment has a conveyor controller 21, a data manager 22, an electric-current-value collection unit 23, a data storage 24, and an abnormality indication unit 25. The conveyor controller 21 controls driving of the conveyor to cause the hanger 15 to move at a predetermined conveying speed. The conveyor controller 21 sends pulse signals synchronized with the movement of the hanger 15. Specifically, every time the pulse signal is generated, the hanger 15 is moved a predetermined distance. The conveying speed of the hanger 15 may vary depending on the types of bodies in some cases.

The electric-current-value collection unit 23 constantly collects the individual values of the electric currents flowing through the electrodes 13. The data manager 22 extracts and acquires the electric current values at proper timings from the result of detection performed by the electric-current-value collection unit 23. With regard to the timings at which the electric current values are extracted, the data manager 22 acquires the electric current values based on the signal indicating the passing of a body sent from the LS 17 and the pulse signals from the conveyor controller 21.

Figure 2:
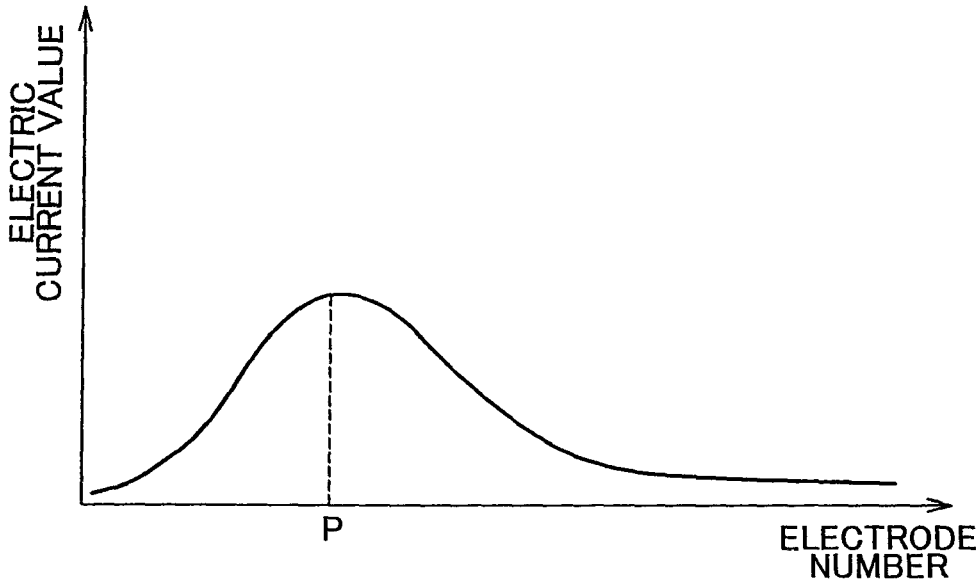
FIG. 2 is a graph showing an example of a relation between the positions of electrodes and electric current values in electrodeposition coating.

Under normal conditions, a relatively large electric current flows between a body and an electrode 13 at the point at which the body is closest to the electrode 13. For example, as shown in FIG. 2, when one body only is conveyed, a relatively large electric current flows through the electrode P that is closest to the point at which the body is being conveyed, and the values of the electric currents that flow through the other electrodes 13 are smaller. In other words, the values of the electric currents flowing through the body at this point have a peak at the electrode P. The electrode numbers that the horizontal axis indicates in FIG. 2 are the numbers that are assigned to the electrodes 13 in order from the upstream side in the conveying direction. The body is conveyed from left to right in FIG. 2, and the peak of the electric current values moves right as the body moves.

Thus, the most part of the electric current value that is obtained at the point at which the body is closest to an electrode 13 is due to the electric current flowing through the body and the electrode 13. Even when there is another body that is also in the electrodeposition bath 11, the influence of such another body is very small. It should be noted that when a plurality of bodies are simultaneously immersed, peaks of the electric current values appear for the electrodes 13 corresponding to the respective positions at which the bodies are being conveyed. That is, the number of peaks of the electric current values is equal to the number of bodies that are in the electrodeposition bath 11.

Thus, the data manager 22 acquires the electric current value for each electrode 13 at the timing at which a body is conveyed to the point closest to the electrode 13 concerned, for example. Alternatively, the data manager 22 acquires the electric current value of an electrode 13 at the position corresponding to the position of a body at the timing at which the electric current value is to be acquired. The data manager 22 may be configured to acquire the electric current values of some electrodes 13 that are adjacent to the electrode 13 closest to the body concerned. Thus, it is possible to acquire the individual values of the electric currents that respectively flow through the electrodes 13 and a body for each body. On the other hand, it is possible to acquire the individual values of the electric currents that respectively flow through bodies and an electrode 13 for each electrode 13. In addition, it is possible to compile the acquired electric current value data to create a data group for each body or for each electrode 13.

The data storage 24 stores the data acquired by the data manager 22. In addition, the threshold values of the electric current values corresponding to the types of bodies and the electrodes 13 are set and stored in the data storage 24 in advance. Furthermore, the data storage 24 compares a stored threshold value and one of the data acquired that corresponds to the body and the electrode(s) concerned. That is, the data manager 22 and the data storage 24 in combination function as the abnormality determination section.

The abnormality indication unit 25 is such that when the abnormality indication unit 25 receives the signal indicating the occurrence of an abnormality from the data manager 22, the abnormality indication unit 25 notifies an operator of the reception. For example, the abnormality indication unit 25 executes a process that switches on an indication light attached near the electrodeposition-coating monitoring system 1, sets off an alarm, etc.

Figure 3:
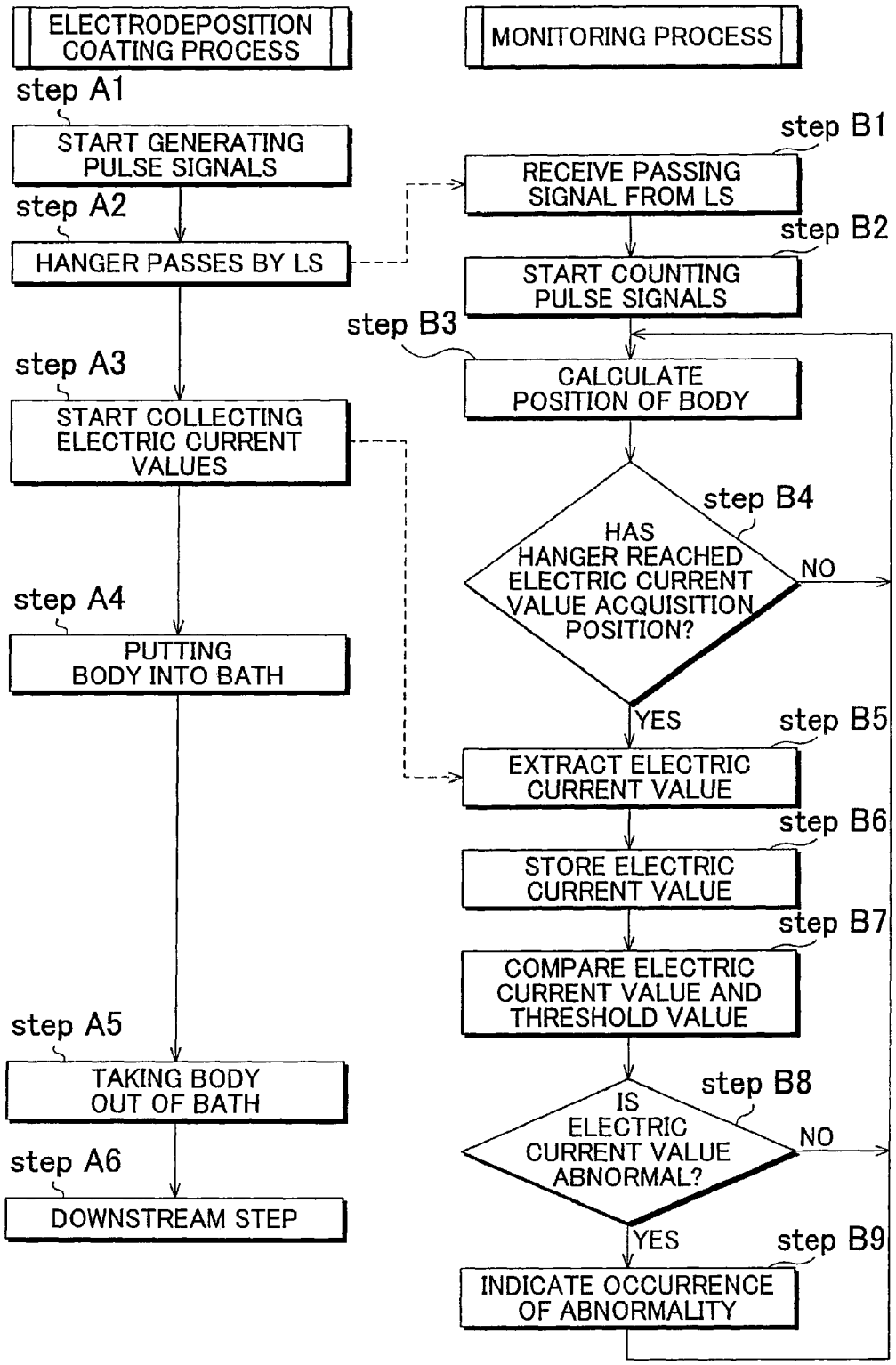
FIG. 3 is a process chart presenting an electrodeposition coating process and a monitoring process side by side.

The monitoring process performed by the electrodeposition-coating monitoring system 1 of this embodiment is performed in parallel with the electrodeposition coating process that is performed by the electrodeposition coating apparatus 10. Thus, an electrodeposition coating process and a monitoring process are shown in FIG. 3, presented side by side. In FIG. 3, a process in which one body is electrodeposition coated is shown. Once the electrodeposition coating process is started, a body is set on the hanger 15, and is conveyed toward the electrodeposition coating apparatus 10. At this stage, the conveyor is in operation, and the generation of pulse signals has been started (step A1).

The hanger 15 on which the body is set advances, and passes by the LS 17 (step A2). At this point, the passing of the hanger 15 is detected by the LS 17, and a passing signal is transmitted. The data manager 22 receives this signal (step B1), which shows that the hanger 15 is near the location of the LS 17 at this time.

Then, the data manager 22 starts to count the pulse signals from the conveyor controller 21 upon reception of the passing signal from the LS 17 (step B2). In this way, it is possible to correctly determine the current position of the hanger 15 based on the location of the LS 17 and the count value after the start of counting.

The application of voltage to the electrodes 13 is started before the body is put into the electrodeposition bath 11. At the same time, the collection of the electric current values performed by the electric-current-value collection unit 23 is started (step A3). Then, the hanger 15 further advances, and the body is put into the electrodeposition bath 11 (step A4). The electrodeposition coating of the body is then started. When the electrodeposition coating is continuously performed, the voltage may be applied to the electrodes 13 without interruption.

Meanwhile, the data manager 22 continues counting the pulse signals from the conveyor controller 21, and calculates the position of the hanger 15 (step B3). In this way, it is monitored whether the hanger 15 has reached the position at which the electric current value is to be detected (step B4). The position at which the electric current value is to be detected is set in advance based on the arrangement of the electrodes 13 in the electrodeposition bath 11, the shape of the body, etc. In this embodiment, the positions at which the electric current values are detected while the bodies are conveyed and the number of such positions can be selected according to the circumstances. Specifically, these parameters may be changed depending on the types of bodies, or may be changed according to the hour within a day.

The electrode 13, of which the electric current value is detected when the hanger 15 reaches a detection position, is also determined in advance. With respect to one body, the number of electrodes 13 for which the electric current values are detected is not limited to one. The electrodeposition-coating monitoring system 1 may be configured such that the electric current values of a plurality of electrodes 13 are simultaneously acquired. In general, it is preferable that the electrode 13 that gives the peak as shown in FIG. 2 corresponding to the current position of the body be selected in advance. Thus, when a plurality of bodies are simultaneously immersed, for each body, the electric current value of the corresponding electrode 13 is detected at respective timings.

In this embodiment, it is also possible to previously set, in the data manager 22, the count value of the pulse signals that are generated until the hanger 15 reaches the position at which the electric current value is to be detected, based on the arrangement of the electrodes 13 of the electrodeposition coating apparatus 10. In this case, when the count of pulse signals reaches the set value, the data manager 22 determines that the hanger 15 has reached the position at which the electric current value is to be detected. The description below will be made on the assumption of such a configuration.

When it is determined that the hanger 15 has reached the position at which the electric current value is to be detected (Yes in step B4), the electric current value of the electrode 13 concerned at this time is extracted from the data collected by the electric-current-value collection unit 23 (step B5). Specifically, of the electric current values that are constantly collected by the electric-current-value collection unit 23, the data manager 22 acquires the electric current value of the concerned electrode 13 corresponding to the proper timing. In addition, the data manager 22 stores the acquired electric current value data along with the present position data in the data storage 24 (step B6).

The data storage 24 compares the electric current value stored in step B6 and the threshold value that is stored in advance, associated with the present position data (step B7). Then, the data storage 24 determines whether the electric current values are within the suitable range (step B8). In particular, in this embodiment, when the electric current value is lower than the corresponding threshold value, it is determined that the electric current value is abnormal. An upper limit threshold value may be set, or otherwise, both upper and lower limit threshold values may be set to determine whether the electric current value is within a proper range. The threshold value varies depending not only on the position of the hanger 15 but also on the construction of the electrodeposition coating apparatus 10, the types of bodies, etc., and is therefore selected appropriately according to what is performed in the coating process.

When the electric current value is not abnormal (No in step B8), the electrodeposition coating process is further continued. When it is determined that the electric current value is abnormal (Yes in step B8), the data manager 22 commands the abnormality indication unit 25 to indicate the occurrence of the abnormality (step B9). However, depending on the degree of abnormality, monitoring may be continued without reaction for a while. It is preferable that the electrodeposition coating process be continued until the system is stopped by an operator even when the electric current value is abnormal.

When the hanger 15 reaches the point in the electrodeposition bath 11 at which the body is to be taken out, the body is lifted along the conveyor and taken out of the electrodeposition bath 11 (step A5). The electrodeposition coating process for the body is thus completed, and the body is sent to the downstream processes, such as a drying process and an overcoating process (step A6).

The data manager 22 of the electrodeposition-coating monitoring system 1 preferably acquires the electric current values for each of the bodies that are fed continuously. When the electric current values are accumulated for each body, it is possible to determine the amount of coating on each body. Meanwhile, when the electric current values are monitored for each of the electrodes 13, it is possible to detect the occurrence of an abnormality in the electrode 13. When the position of the electrode 13 of which the electric current value is abnormal is graphically shown, it is possible to detect the occurrence of an abnormality in a plurality of neighboring electrodes 13, or in the electrodes 13 related to each other at an early stage.

As described in detail above, according to the monitoring system 1 of this embodiment, it is possible to automatically acquire the electric current value when the hanger 15 reaches the predetermined position. In addition, it is possible to determine whether there is some failure in the system by comparing the acquired electric current value and the threshold value. Thus, it is possible to monitor the electrodeposition coating process, quickly detect the occurrence of a failure in the system, and provide notification about such an occurrence. In addition, when the electrodeposition-coated articles are manufactured while the coating process is being monitored, it is possible to manufacture electrodeposition-coated articles that are favorably coated.

This embodiment is merely an example, and the invention is not limited to the embodiment at all. Thus, needless to say, various modifications and alterations can be made to the invention without departing from the spirit of the invention. For example, the position of the LS 17 is not limited to the position before the entrance point at which bodies are put into the bath, but may be the position immediately after such an entrance point. When a lot of LSs are prepared and arranged along the conveyor, it is possible to omit the counting of the pulse signals. The data obtained by such many LSs is also included in the "data concerning a carried distance." When the electric current value becomes abnormal, putting a new body into the bath may be stopped.

While the invention has been described with reference to an example embodiment thereof, it is to be understood that the invention is not limited to the described embodiment or constructions. To the contrary, the invention is intended to cover various modifications and equivalent arrangements. In addition, while the various elements of the example embodiment are shown in various combinations and configurations, other combinations and configurations, including more, less or only a single element, are also within the spirit and scope of the invention.

The invention claimed is:

1. An electrodeposition-coating monitoring system for monitoring electrodeposition coating of an object to be coated, comprising:

an electrodeposition bath that contains an electrodeposition paint;

a conveying mechanism that conveys the object to be coated while the object is immersed in the electrodeposition paint in the electrodeposition bath;

a plurality of electrodes arranged along a conveying direction in which the object to be coated is conveyed by the conveying mechanism;

a present-position-data acquisition section that acquires present position data of the object to be coated in the conveying direction in which the object to be coated is conveyed by the conveying mechanism;

an electric-current-data collection section that collects individual values of electric currents that flow through the plurality of electrodes, respectively; and an abnormality determination section that determines an occurrence of an abnormality in electrodeposition coating based on the electric current value, collected by the electric-current-data collection section, of the electrode positioned at a point corresponding to the present position data acquired by the present-position-data acquisition section.

2. The electrodeposition-coating monitoring system according to claim 1, wherein the present-position-data acquisition section acquires the present position data based on data concerning a carried distance by which the object to be coated is carried along the conveying mechanism.

3. The electrodeposition-coating monitoring system according to claim 1, wherein the present-position-data acquisition section acquires the present position data based on data obtained from the conveying mechanism.

4. The electrodeposition-coating monitoring system according to claim 1, further comprising:

a passing sensor that outputs a passing signal when the object to be coated passes by a predetermined point on the conveying mechanism;

a conveying signal output section that outputs a conveying signal that periodically varies while the conveying mechanism is conveying the object to be coated; and a counter that is started by the passing signal and counts cycles by which the conveying signal periodically varies, wherein the present-position-data acquisition section uses a cycle count taken by the counter as the present position data.

5. The electrodeposition-coating monitoring system according to claim 1, wherein, when the present position data acquired by the present-position-data acquisition section has a value corresponding to a predetermined determination position, the abnormality determination section acquires one, corresponding to a predetermined electrode associated with the determination position, of the electric current values collected by the electric-current-data collection section, and based on whether the acquired electric current value is within a predetermined range, the abnormality determination section determines the occurrence of the abnormality for the object to be coated that is positioned at the determination position.

6. The electrodeposition-coating monitoring system according to claim 1, further comprising an abnormality notification device that, when the abnormality determination section detects the occurrence of the abnormality, provides notification about the occurrence of the abnormality.

7. An electrodeposition-coating monitoring method in which electrodeposition coating of an object to be coated is monitored that uses an electrodeposition bath that contains an electrodeposition paint, a conveying mechanism that conveys the object to be coated while the object is immersed in the electrodeposition paint in the electrodeposition bath, and a plurality of electrodes arranged along a conveying direction in which the object to be coated is conveyed by the conveying mechanism, the electrodeposition-coating monitoring method comprising:

acquiring present position data of the object to be coated in the conveying direction in which the object to be coated is conveyed by the conveying mechanism;

acquiring an electric current value of the electrode positioned at a point corresponding to the acquired present position data; and determining an occurrence of an abnormality in the electrodeposition coating based on the acquired electric current value.

8. The electrodeposition-coating monitoring method according to claim 7, wherein the present position data is acquired based on data concerning a carried distance by which the object to be coated is carried along the conveying mechanism.

9. The electrodeposition-coating monitoring method according to claim 7, wherein the present position data is acquired based on data obtained from the conveying mechanism.

10. The electrodeposition-coating monitoring method according to claim 7, further comprising:

outputting a conveying signal that periodically varies while the conveying mechanism is conveying the object to be coated;

counting cycles by which the conveying signal periodically varies, from when the object to be coated passes by a predetermined point on the conveying mechanism; and using a thus-obtained cycle count as the present position data of the object to be coated in the conveying direction in which the object to be coated is conveyed by the conveying mechanism.

11. The electrodeposition-coating monitoring method according to claim 7, wherein:

in acquiring the electric current value, when the acquired position data has a value corresponding to a predetermined determination position, an electric current value corresponding to a predetermined one, associated with the determination position, of the plurality of electrodes is acquired; and in determining the occurrence of the abnormality, the occurrence of the abnormality for the object to be coated that is positioned at the determination position is determined based on whether the acquired electric current value is within a predetermined range.

12. The electrodeposition-coating monitoring method according to claim 7, further comprising, when the occurrence of the abnormality is detected, causing an abnormality notification device to provide notification about the occurrence of the abnormality.

13. A method of manufacturing an electrodeposition-coated article in which an electrodeposition bath that contains an electrodeposition paint, a conveying mechanism that conveys an object to be coated while the object is immersed in the electrodeposition paint in the electrodeposition bath, and a plurality of electrodes arranged along a conveying direction in which the object to be coated is conveyed by the conveying mechanism are used, the method comprising:

acquiring present position data of the object to be coated in the conveying direction in which the object to be coated is conveyed by the conveying mechanism;

acquiring an electric current value of the electrode positioned at a point corresponding to the acquired present position data; and performing electrodeposition coating while repeatedly determining an occurrence of an abnormality in the electrodeposition coating based on the acquired electric current value.

14. The method of manufacturing an electrodeposition-coated article according to claim 13, wherein the present position data is acquired based on data concerning a carried distance by which the object to be coated is carried along the conveying mechanism.

15. The method of manufacturing an electrodeposition-coated article according to claim 13, wherein the present position data is acquired based on data obtained from the conveying mechanism.

16. The method of manufacturing an electrodeposition-coated article according to claim 13, further comprising:

outputting a conveying signal that periodically varies while the conveying mechanism is conveying the object to be coated;

counting cycles by which the conveying signal periodically varies, from when the object to be coated passes by a predetermined point on the conveying mechanism; and using a thus-obtained cycle count as the present position data of the object to be coated in the conveying direction in which the object to be coated is conveyed by the conveying mechanism.

17. The method of manufacturing an electrodeposition-coated article according to claim 13, wherein:

in acquiring the electric current value, when the acquired position data has a value corresponding to a predetermined determination position, an electric current value corresponding to a predetermined one, associated with the determination position, of the plurality of electrodes is acquired; and in determining the occurrence of the abnormality, the occurrence of the abnormality for the object to be coated that is positioned at the determination position is determined based on whether the acquired electric current value is within a predetermined range.

18. The method of manufacturing an electrodeposition-coated article according to claim 13, further comprising:

when the occurrence of the abnormality is detected, causing an abnormality notification device to provide notification about the occurrence of the abnormality.

* * * * *